US009975561B2

(12) United States Patent
Chan et al.

(10) Patent No.: US 9,975,561 B2
(45) Date of Patent: May 22, 2018

(54) POWER SYSTEM FOR LOCOMOTIVES

(71) Applicant: Elwha LLC, Bellevue, WA (US)

(72) Inventors: Alistair K. Chan, Bainbridge Island, WA (US); Roderick A. Hyde, Redmond, WA (US); Jordin T. Kare, San Jose, CA (US); Nathan P. Myhrvold, Medina, WA (US); Lowell L. Wood, Jr., Bellevue, WA (US)

(73) Assignee: Elwha LLC, Bellevue, WA (US)

( * ) Notice: Subject to any disclaimer, the term of this patent is extended or adjusted under 35 U.S.C. 154(b) by 188 days.

(21) Appl. No.: 14/657,606

(22) Filed: Mar. 13, 2015

(65) Prior Publication Data

US 2016/0264154 A1 Sep. 15, 2016

(51) Int. Cl.
*B61C 17/02* (2006.01)
*B61C 5/00* (2006.01)

(52) U.S. Cl.
CPC ..... *B61C 17/02* (2013.01); *B61C 5/00* (2013.01)

(58) Field of Classification Search
CPC .... B61C 5/00; B61C 5/02; B61C 5/04; B61C 8/00; B61C 17/00; B61C 17/02; F02C 3/00; F02C 5/00; F02C 5/06; F02C 7/00; F02C 7/22; F02C 9/00; F02C 9/16; F02C 9/26

See application file for complete search history.

(56) References Cited

U.S. PATENT DOCUMENTS

| | | | | |
|---|---|---|---|---|
| 4,238,925 | A * | 12/1980 | Lowther | F02C 5/00 60/39.461 |
| 6,067,973 | A | 5/2000 | Chanda et al. | |
| 6,523,349 | B2 | 2/2003 | Viteri | |
| 6,742,507 | B2 | 6/2004 | Keefer et al. | |
| 2014/0034151 | A1 * | 2/2014 | Foege | B61C 17/02 137/345 |

OTHER PUBLICATIONS

Clean-Diesel Breakthrough: Simultaneous Decrease in Emissions of Both Particulates and Oxides of Nitrogen during Combustion, Argonne National Laboratory, 1999, 7 pages.

Yelvington et al., "Oxygen-Enriched Combustion for Military Diesel Engine Generators", Mainstream Engineering, 2009, 2 pages.

* cited by examiner

*Primary Examiner* — Robert J McCarry, Jr.
(74) *Attorney, Agent, or Firm* — Foley & Lardner LLP

(57) ABSTRACT

A train includes a fuel storage tank configured to contain liquid fuel, a locomotive including an engine having an intake and configured to combust the fuel in a combustion reaction to provide a power output, an oxidant storage tank configured to contain at least liquid oxygen, and a vaporizer disposed along the flow path between the oxidant storage tank and the intake. The vaporizer is configured to convert a portion of the liquid oxygen into a flow of gaseous oxygen and provide the flow of gaseous oxygen to the intake thereby increasing the power output of the engine.

36 Claims, 9 Drawing Sheets

POWER SYSTEM FOR LOCOMOTIVES

BACKGROUND

Natural gas may be used as a fuel source for trains. Natural gas is an attractive alternative to diesel fuel because it can be less expensive to produce and procure, while producing less carbon dioxide when combusted. Natural gas is readily available as a fossil fuel and can also be produced from waste at man-made facilities.

Traditional locomotives, including natural gas-fueled locomotives, combust fuel to provide a tractive force used to pull or push one or more railroad cars. Such locomotives travel across varying terrain that may include one or more upward grades. On grade, the locomotive must pull or push the railroad cars with a force that is greater than the force required to move the railroad cars on flat sections of the railroad line. Traditional locomotives lack the power and responsiveness needed to maintain speed over such grades, thereby reducing throughput on the railroad line and decreasing profitability. Traditional locomotives also generate emissions that may exceed accepted limits (e.g., limits imposed by cities, limits imposed by government agencies, etc.), thereby resulting in payment of emissions penalties.

SUMMARY

One embodiment relates to a train that includes a fuel storage tank configured to contain liquid fuel, a locomotive including an engine having an intake and configured to combust the fuel in a combustion reaction to provide a power output, an oxidant storage tank configured to contain at least liquid oxygen, and a vaporizer disposed along the flow path between the oxidant storage tank and the intake. The vaporizer is configured to convert a portion of the liquid oxygen into a flow of gaseous oxygen and provide the flow of gaseous oxygen to the intake thereby increasing the power output of the engine.

Another embodiment relates to a power system for a locomotive that includes a fuel storage tank configured to contain liquid fuel, an engine having an intake and configured to combust the fuel in a combustion reaction to provide a power output, an oxidant storage tank configured to contain at least liquid oxygen, and a vaporizer coupled to the oxidant storage tank and configured to convert a portion of the liquid oxygen into a flow of gaseous oxygen. The vaporizer is coupled to the intake such that the flow of gaseous oxygen to the intake increases the power output of the engine.

Still another embodiment relates to a fuel management system that includes a train and a depot site. The train includes a fuel storage tank configured to contain liquid fuel, an oxidant storage tank configured to contain at least liquid oxygen, a vaporizer coupled to the oxidant storage tank and configured to convert a portion of the liquid oxygen into a flow of gaseous oxygen, and a locomotive including an engine having an intake and configured to combust the fuel in a combustion reaction to provide a power output. The vaporizer is coupled to the intake such that the flow of gaseous oxygen to the intake increases the power output of the engine. The depot site includes a heat exchanger configured to facilitate liquefying at least gaseous oxygen into at least liquid oxygen.

Yet another embodiment relates to a power system for a locomotive that includes a fuel storage tank configured to contain liquid fuel, an engine configured to combust the fuel in a combustion reaction that produces a plurality of exhaust constituents, an oxidant storage tank configured to contain at least liquid oxygen, and a vaporizer. The engine includes an intake and an exhaust that are coupled by a recirculating flow path, and at least a portion of the exhaust constituents form a working fluid that flows along the recirculating flow path. The vaporizer is coupled to the oxidant storage tank and configured to provide a flow of gaseous oxygen to the working fluid along the recirculating flow path to perpetuate the combustion reaction.

Another embodiment relates to a method of powering a train that includes providing a fuel storage tank configured to contain liquid fuel, providing an oxidant storage tank configured to contain at least liquid oxygen, converting a portion of the liquid oxygen into a flow of gaseous oxygen, and combining the flow of gaseous oxygen and the fuel for combustion in an engine of a locomotive. The flow of gaseous oxygen increases a power output of the engine.

Another embodiment relates to a method of powering a train that includes providing a fuel storage tank configured to contain liquid fuel, providing an oxidant storage tank configured to contain at least liquid oxygen, and combusting the fuel in an engine as part of a combustion reaction. The engine includes an intake and an exhaust that are coupled by a recirculating flow path, and a plurality of exhaust constituents form a working fluid that flows along the recirculating flow path. The method also includes converting a portion of the liquid oxygen into a flow of gaseous oxygen and introducing the flow of gaseous oxygen into the working fluid to perpetuate the combustion reaction.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
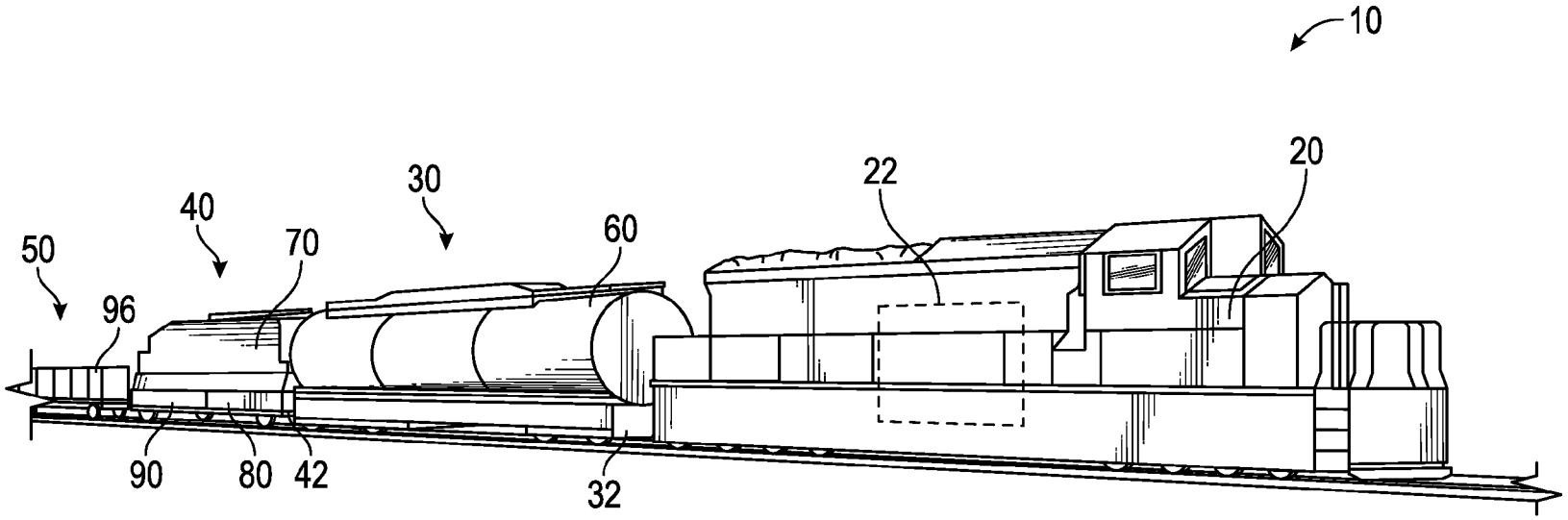
FIG. 1 is a perspective view of a train, according to one embodiment.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

According to one embodiment, a power system for a locomotive includes an engine and an oxidant storage tank configured to contain an oxidant. The oxidant facilitates combustion of fuel (e.g., methane, etc.) within the engine. In one embodiment, the oxidant includes an enhanced (i.e., magnified, increased, etc.) level of oxygen, thereby defining an oxygen-enhanced oxidant. By way of example, the oxygen-enhanced oxidant may have a level of oxygen that is greater than that of ambient air or may be pure oxygen. The power system is configured to provide the oxygen-enhanced oxidant to the engine, thereby increasing the power output, or increasing the responsiveness to a burst-rate power demand, relative to an engine combusting a mixture of fuel (e.g., methane, etc.) and air. The liquid fuel (e.g., liquid methane, diesel, etc.) and the oxidant may be stored in liquid form within a fuel storage tank and the oxidant storage tank, respectively.

The power system may be configured to continuously provide the oxygen-enhanced oxidant continuously, based upon a user input, based upon the position of the train, or based upon still other factors. By way of example, the power system may be configured to provide the oxygen-enhanced oxidant when an operator indicates that the train is traveling up a grade, when a sensor indicates that the train is traveling up a grade, when a positioning system indicates that the train is traveling up a grade, or under still other conditions such that the power output of the engine is increased. The increased power output or responsiveness to a burst-rate power demand may be used by the train to scale the grade more quickly than traditional trains (i.e., the increased power output facilitates maintaining speed on grade, etc.). The engine of the train may run on ambient air during other periods where the oxygen-enhanced oxidant is not provided thereto.

The oxygen-enhanced oxidant may also decrease the emissions of the engine (e.g., by reducing the diffusion blocking of combustion oxygen that occurs due to excess nitrogen found in ordinary air, etc.). A train may be operated in various environments, including areas that are sensitive to mono-nitrogen oxide (e.g., nitric oxide, nitrogen dioxide, etc.) emissions ("$NO_x$ emissions"), carbonaceous particulates, or other contaminants. In one embodiment, the power system is configured to provide the oxygen-enhanced oxidant to the engine to reduce emissions therefrom. The power system may be configured to provide the oxygen-enhanced oxidant continuously, based upon a user input, based upon the position of the train, or based upon still other factors. By way of example, the power system may be configured to provide the oxygen-enhanced oxidant when the train travels within a predefined region.

Referring to the embodiment shown in FIG. 1, a train, shown as train 10, includes a locomotive, shown as locomotive 20. Locomotive 20 includes engine 22. In one embodiment, engine 22 includes an engine fueled by at least one of diesel fuel and methane gas. As shown in FIG. 1, train 10 includes first railroad car 30, second railroad car 40, and third railroad car 50. In other embodiments, train 10 includes more or fewer railroad cars. As shown in FIG. 1, first railroad car 30 and second railroad car 40 include frame 32 and frame 42, respectively. According to the embodiment shown in FIG. 1, locomotive 20 is positioned at the front of train 10 and configured to pull first railroad car 30, second railroad car 40, and third railroad car 50. According to another embodiment, locomotive 20 is positioned at the rear of train 10 and configured to push first railroad car 30, second railroad car 40, and third railroad car 50. According to still another embodiment, at least one locomotive 20 is positioned at the front of train 10, and at least one locomotive 20 is positioned at the rear of train 10, thereby pulling and pushing a plurality of intermediate rail cars.

As shown in FIG. 1, train 10 includes fuel storage tank 60 and oxidant storage tank 70. In one embodiment, fuel storage tank 60 is configured to contain liquid fuel (e.g., liquid methane, diesel, etc.) and oxidant storage tank 70 is configured to contain a liquid oxidant (e.g., liquid pure oxygen, liquid air including liquid oxygen, etc.). In one embodiment, at least one of the liquid fuel and the liquid oxidant is cryogenic (i.e., stored at a temperature at or below −150° C.). In other embodiments, the fuel is a liquid at room temperature. As shown in FIG. 1, fuel storage tank 60 is coupled to frame 32 of first railroad car 30 and oxidant storage tank 70 is coupled to frame 42 of second railroad car 40. According to another embodiment, fuel storage tank 60 and oxidant storage tank 70 are both supported by frame 32 of first railroad car 30. Fuel from fuel storage tank 60 may be combusted within engine 22 to power train 10. By way of example, liquid fuel from fuel storage tank 60 may be vaporized and provided to engine 22, thereby forming a fuel flow. Characteristics (e.g., flow rate, pressure, etc.) of the fuel flow may be regulated with a flow device. It should be understood that methane may be stored within fuel storage tank 60 in pure form, as natural gas including methane and other constituents (e.g., contaminants, etc.), or in still another form.

Referring again to FIG. 1, train 10 includes vaporizer 80 that is coupled to oxidant storage tank 70. By way of example, a conduit may place vaporizer 80 in fluid communication with oxidant storage tank 70. In one embodiment, vaporizer 80 is configured to convert a portion of at least the liquid oxygen from oxidant storage tank 70 into a flow of at least gaseous oxygen. A power system for a locomotive may include fuel storage tank 60, oxidant storage tank 70, engine 22, and vaporizer 80. The power system may be entirely contained on locomotive 20 or may have at least one component coupled to a railroad car that is pulled behind or pushed in front of locomotive 20. According to the embodiment shown in FIG. 1, vaporizer 80 is coupled to frame 42 of second railroad car 40. In other embodiments, vaporizer 80 is provided as part of locomotive 20.

An additional vaporizer may be positioned to vaporize or otherwise atomize the liquid fuel of fuel storage tank 60 (e.g., liquid methane, diesel, etc.) before it enters engine 22. In one embodiment, the vaporizer positioned to vaporize the fuel and vaporizer 80 each use one of an external heat source and a heat exchanger thermally coupled to a thermal ballast, thereby forming four potential device combinations. The external heat source may be electric, may use heat from the engine, may use heat from an exhaust system, or may be still another device. The thermal ballast may start as ambient air. A heat exchanger may extract heat from the thermal ballast and provide the heat to the oxygen-enhanced oxidant (e.g., liquid oxygen, etc.) and/or the liquid fuel (e.g., liquid methane, etc.) in order to vaporize them. As heat is extracted from the thermal ballast by the heat exchanger, the thermal ballast is cooled. The thermal ballast may be cooled to form a cold gas that may be exhausted. At least a portion of the thermal ballast may be liquefied (e.g., to liquid nitrogen, to liquid oxygen, etc.), and the liquefied cryogenic thermal ballast may be exhausted or retained. Cryogenic thermal ballast including liquid oxygen may be stored in oxidant storage tank 70. In other embodiments, the cryogenic thermal ballast is stored separately. The cryogenic thermal ballast may be used to extract heat from the ambient air and form liquid oxygen-enhanced oxidant that is provided to engine 22 by the power system of train 10. In other embodiments, the cryogenic thermal ballast is offloaded into a storage tank at an off-train station. In other embodiments, at least one of the vaporizer positioned to vaporize the fuel and vaporizer 80 use still another process, system, device, or components to vaporize or otherwise atomize the fuel and the oxygen-enhanced oxidant, respectively.

Figure 2:
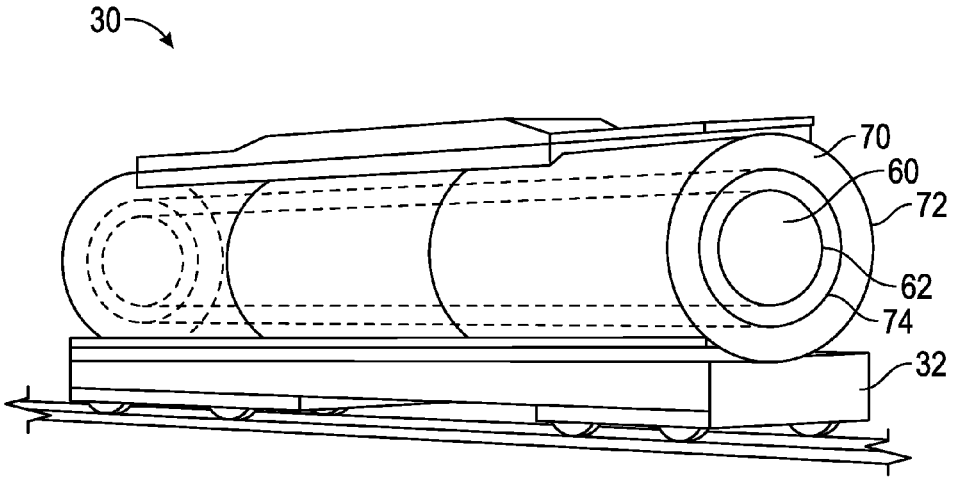
FIG. 2 is a perspective view of an oxidant storage tank disposed along a fuel storage tank, according to one embodiment.

Referring next to the embodiment shown in FIG. 2, fuel storage tank 60 is disposed along oxidant storage tank 70. As shown in FIG. 2, fuel storage tank 60 and oxidant storage tank 70 are disposed within a double bulkhead tank. In other embodiments, fuel storage tank 60 and oxidant storage tank 70 are disposed along one another and otherwise form a double bulkhead tank. Storage systems for fluids, including liquid methane, are discussed in U.S. application Ser. No. 14/054,605, titled "Systems and Methods for Fluid Containment," filed Oct. 15, 2013, which is incorporated herein by reference in its entirety. As shown in FIG. 2, fuel storage tank 60 is at least partially within oxidant storage tank 70, thereby reducing the insulation needed to decrease boil-off of the liquid oxygen and the liquid fuel (e.g., liquid methane, etc.). In another embodiment, oxidant storage tank 70 is at least partially within fuel storage tank 60. As shown in FIG. 2, fuel storage tank 60 includes first tube 62 that is disposed within second tube 72. In one embodiment, the volume between an outer surface of first tube 62 and an inner surface of second tube 72 defines oxidant storage tank 70. In the embodiment shown in FIG. 2, the liquid oxygen is separated from the liquid fuel by a buffer fluid (e.g., liquid nitrogen, etc.) disposed within a third tube 74.

Referring next to FIGS. 3A-5, schematic illustrations of power systems of train 10 are shown, according to various embodiments. As shown in FIGS. 3A-5, engine 22 includes intake 24 and exhaust 26. Engine 22 is configured to combust the fuel in a combustion chamber as part of a combustion reaction. In one embodiment, the combustion reaction provides a power output used to impart a motive force to move train 10. As shown in FIGS. 3A-5, vaporizer 80 is coupled to intake 24 such that flow of gaseous oxygen 82 is provided to engine 22. In one embodiment, flow of gaseous oxygen 82 increases the power output or increases the responsiveness to a burst-rate power demand of engine 22. According to another embodiment, flow of gaseous oxygen 82 decreases the emissions (e.g., $NO_x$ emissions, carbonaceous particulates, etc.) of engine 22. In one embodiment, liquid oxygen is the only oxidizer used to supplement the fuel during combustion in engine 22. In another embodiment, air is the only oxidizer. In some embodiments, at least one of air (e.g., ambient air, etc.), liquid air, and liquid oxygen (e.g., stored in oxidant storage tank 70, etc.) are used.

As shown in FIGS. 3A-5, vaporizer 80 includes an inlet, shown as inlet 76. Inlet 76 is in fluid communication with oxidant storage tank 70 such that an oxidant (e.g., liquid air, liquid oxygen, etc.) is provided to vaporizer 80. Vaporizer 80 receives the oxidant and vaporizes (e.g., heats, boils, etc.) the oxidant such that gaseous oxygen 82 is received by intake 24 of engine 22. In some embodiments, a buffer tank for gaseous oxygen is coupled between vaporizer 80 and engine 22 such that oxygen flow to engine 22 may be varied separately (e.g., more rapidly, etc.) than output from vaporizer 80. In one embodiment, vaporizer 80 uses an external heat source to vaporize the oxidant. By way of example, the external heat source may be electric, may use heat from engine 22, may use heat from exhaust 26, or may be still another device. In other embodiments, vaporizer 80 is coupled to a thermal ballast system 96 (e.g., a heat exchanger that uses ambient air, gaseous oxygen, fuel, etc.).

By way of example, the thermal ballast system 96 may act as a parallel-flow heat exchanger, a counter-flow heat exchanger, a cross-flow heat exchanger, or still another type of heat exchanger. In one embodiment, as the liquid oxidant flows through vaporizer 80, the liquid oxidant is in thermal communication with at least one of ambient air, gaseous oxygen, and fuel. The elevated temperature of the thermal ballast (e.g., as compared to liquid air, liquid oxygen, etc.) heats the liquid oxidant, while the lower temperature of the liquid oxidant (e.g., as compared to gaseous air, gaseous oxygen, etc.) cools the thermal ballast. The liquid oxidant is in turn vaporized as it is passed through vaporizer 80.

According to one embodiment, the cooled air or liquefied air of the cryogenic thermal ballast is released into the ambient environment. In another embodiment, all or part of the cooled air is liquefied. By way of example, the air within the thermal ballast system may be sufficiently cooled to convert the state of the gaseous air completely into liquefied air (i.e., a mixture of liquid oxygen and liquid nitrogen, etc.) that may be stored in oxidant storage tank 70. In another embodiment, the gaseous nitrogen, having a lower boiling point than oxygen (i.e., condenses at a lower temperature, etc.), is exhausted from the thermal ballast system once the gaseous oxygen in the air is liquefied, which may be stored in oxidant storage tank 70. In another embodiment, the liquid air may be stored. The stored liquid air may be used to supplement future use of the cryogenic thermal ballast, aiding in the conversion of gaseous air into either liquid air or liquid oxygen. The stored liquid air may also be offloaded into an external storage tank at an off-train station. It should be noted that instead of air flowing through the thermal ballast system, as described above, gaseous oxygen may be used instead.

Figure 3A:
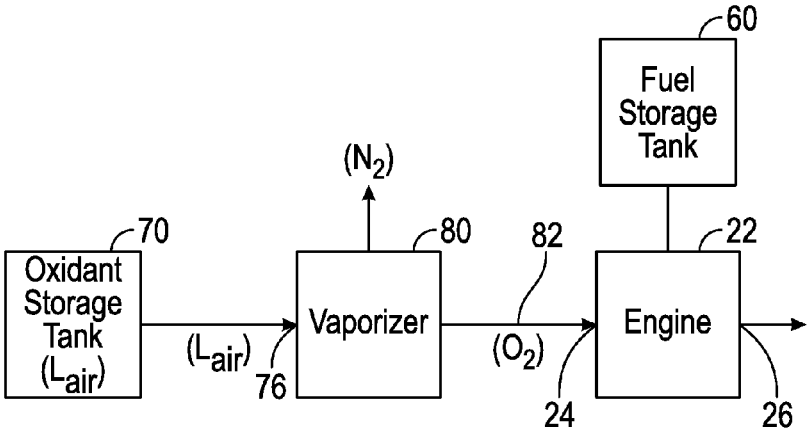
FIGS. 3A-5 are schematic views of a power system for a locomotive, according to various embodiments.
Figure 3B:
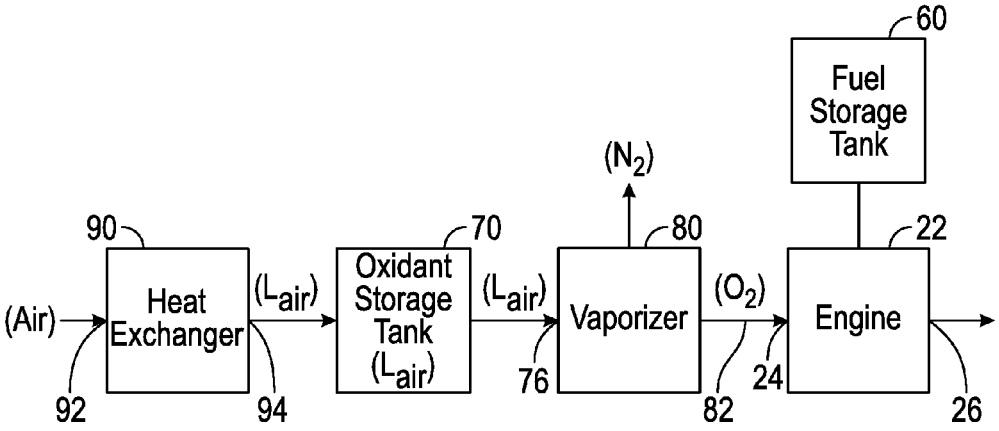
Figure 3C:
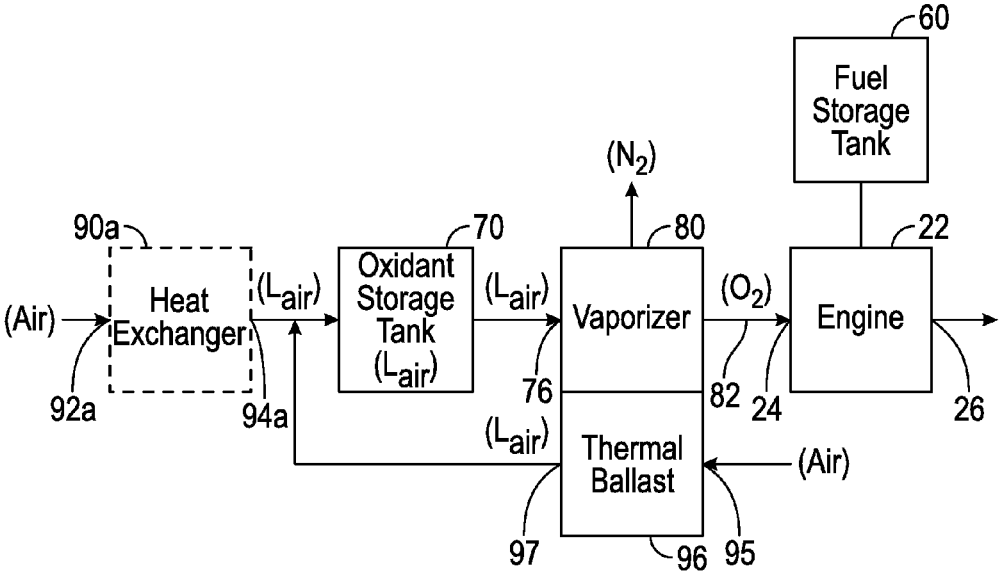

Referring now to FIGS. 3A-3C, a power system of train 10 is shown to store liquid air. As shown in FIGS. 3A-3C, oxidant storage tank 70 is configured to store liquid air (i.e., a mixture of liquid oxygen and liquid nitrogen, etc.). In other embodiments, oxidant storage tank 70 stores other liquid oxidants (e.g., liquid oxygen, etc.). As shown in FIGS. 3A-3C, oxidant storage tank 70 is in fluid communication with vaporizer 80 such that liquid air is provided to vaporizer 80. Vaporizer 80 vaporizes the liquid air, exhausting the gaseous nitrogen into the ambient environment, while directing gaseous oxygen 82 to intake 24 of engine 22. Vaporizer 80 may thereby function as a separator based upon fractional distillation.

By way of example, as the liquid oxidant is vaporized, liquid nitrogen, having a lower boiling point (e.g., of −196° C.) than oxygen (e.g., of −183° C.), is converted into a gaseous state (e.g., gaseous nitrogen, etc.) earlier in the vaporization process (e.g., before the liquid oxygen, etc.). In turn, the gaseous nitrogen is exhausted into the ambient environment, while the later-converting gaseous oxygen 82 is sent to intake 24 of engine 22. In one embodiment, vaporizer 80 includes an exhaust port (e.g., nozzle, outlet, vent, etc.) configured to discharge the gaseous nitrogen to the surrounding atmosphere without venting liquid or gaseous oxygen 82. By way of example, as heat is added to the liquid air, the liquid nitrogen will boil first. As such, the exhaust port may be located in a position along vaporizer 80 where substantially all of the liquid nitrogen has vaporized, but before the liquid oxygen has vaporized. The nitrogen may thereby be removed from the mixture, leaving substantially pure liquid oxygen to be vaporized. In another embodiment, the liquid oxidant is liquid oxygen in which it is converted into gaseous oxygen 82 via vaporizer 80 and sent to intake 24 of engine 22.

In another embodiment, vaporizer 80 is accompanied by a distinct separator. Such a separator may be at least one of disposed along a flow path between oxidant storage tank 70 and vaporizer 80, interspersed with components of vaporizer 80, and disposed between vaporizer 80 and engine 22. The separator may be configured to separate gaseous nitrogen from the gaseous oxidant, thereby enriching the gaseous oxygen content of oxidant supplied to engine 22. The gaseous nitrogen may be discharged to the surrounding atmosphere. In one embodiment, the separator includes a pressure swing adsorption unit. The pressure swing absorption unit may be configured to pressurize the oxidant flow and expose the pressurized fluid to an adsorbent material (e.g., a zeolite sponge, etc.), which acts as a molecular sieve. One or more constituents (e.g., nitrogen, etc.) may be adsorbed based on their differential attraction to the adsorbent material relative to oxygen. The separator may thereafter depressurize the oxidant flow to release the adsorbed gas molecules and regenerate the adsorbent material. In other embodiments, the separator includes at least one of a double-stage pressure swing adsorption unit, a rapid pressure swing adsorption unit, a vacuum pressure swing adsorption unit, a membrane separation unit, and still another system configured to increase the ratio of oxygen to other gases within the oxidant flow.

According to the embodiment shown in FIG. 3A, oxidant storage tank 70 is in fluid communication with vaporizer 80 (e.g., train 10 may not include on-board air liquefying equipment coupled to it, etc.). In one embodiment, oxidant storage tank 70 receives liquid air from an external source (e.g., at a fill station, etc.) when its liquid air reserves have been depleted, for example. In other embodiments, the railway car (e.g., first railroad car 30, second railroad car 40, third railroad car 50, etc.) that oxidant storage tank 70 is coupled to is exchanged at a railway station for another railway car with a full oxidant storage tank 70.

According to the embodiment shown in FIG. 3B, the power system includes a liquefier, shown as heat exchanger 90. In one embodiment, heat exchanger 90 is thermally coupled to vaporizer 80. Such thermal coupling may facilitate a transfer of energy from heat exchanger 90 to vaporizer 80 (e.g., to facilitate generating liquid oxygen in heat exchanger 90 and gaseous oxygen in vaporizer 80, etc.). Heat exchanger 90 is configured to decrease the temperature of the gaseous air from an air source (e.g., the ambient environment, etc.) to facilitate production of liquid air. In one embodiment, heat exchanger 90 liquefies the gaseous air to produce liquid air. In another embodiment, heat exchanger 90 reduces the temperature of the gaseous air and includes another device (e.g., a compressor, another thermal regulation unit, etc.) that facilitates producing liquefied air. As shown in FIG. 3B, heat exchanger 90 includes inlet 92 and outlet 94. Inlet 92 may be in fluid communication with the air source. In one embodiment, heat exchanger 90 is coupled to oxidant storage tank 70. As shown in FIG. 3B, outlet 94 of heat exchanger 90 is coupled to an inlet of oxidant storage tank 70 such that liquid air from heat exchanger 90 may be stored for later use. Oxidant storage tank 70, vaporizer 80, and heat exchanger 90 may be supported by a frame of the same railroad car.

According to the embodiment shown in FIG. 3C, the power system includes thermal ballast system 96 and auxiliary heat exchanger 90*a*. As shown in FIG. 3C, thermal ballast system 96 and vaporizer 80 are in thermal communication such that ambient air flowing through thermal ballast system 96 transfers heat to the liquid air flowing through vaporizer 80. Thermal ballast system 96 is configured to drive vaporizer 80 to vaporize the liquid air and facilitate the separation of gaseous nitrogen from gaseous oxygen 82, as well as provide a supply of gaseous oxygen 82 to engine 22. In another embodiment, thermal ballast system 96 is in thermal communication with a liquid fuel vaporizer of fuel storage tank 60 such that ambient air flowing through thermal ballast system 96 transfers heat to the liquid fuel, vaporizing the liquid fuel and cooling (e.g., liquefying, etc.) the gaseous air.

As shown in FIG. 3C, thermal ballast system 96 includes inlet 95 and outlet 97. Inlet 95 may be in fluid communication with the air source (e.g., ambient air, etc.). In one embodiment, outlet 97 of thermal ballast system 96 is coupled to oxidant storage tank 70. By way of example, thermal ballast system 96 may liquefy the gaseous air to produce liquid air, i.e., to function like heat exchanger 90. In another embodiment, thermal ballast system 96 reduces the temperature of the gaseous air and includes another device (e.g., a compressor, another thermal regulation unit, etc.) that facilitates producing liquefied air. As shown in FIG. 3C, outlet 97 of thermal ballast system 96 is coupled to an inlet of oxidant storage tank 70 such that liquid air from thermal ballast system 96 may be stored for later use. In other embodiments, outlet 97 is coupled directly to oxidant storage tank 70. In still another embodiment, the product of thermal ballast system 96 (e.g., liquid air, cooled gaseous air, etc.) is exhausted. As shown in FIG. 3C, thermal ballast system 96 optionally includes auxiliary heat exchanger 90*a*, which is configured to receive gaseous air (e.g., ambient air, etc.) through inlet 92*a* and liquefy the gaseous air for storage in oxidant storage tank 70 for later use. The liquefied air is transferred to the oxidant storage tank 70 through the fluid communication between outlet 94*a* of auxiliary heat exchanger 90*a* and an inlet of oxidant storage tank 70. By way of example, auxiliary heat exchanger 90*a* may be used where the process performed by vaporizer 80 and thermal ballast system 96 does not produce enough liquid air for the power demands of engine 22.

Figure 4A:
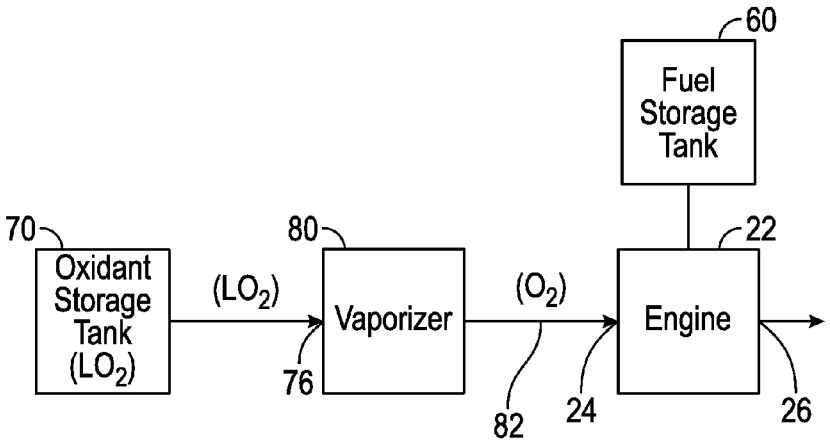
Figure 4B:
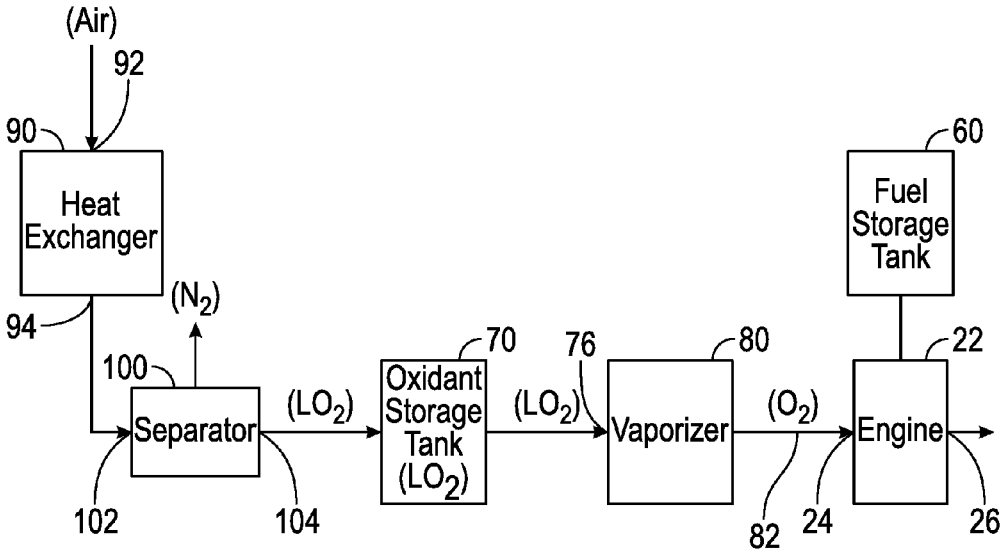
Figure 4C:
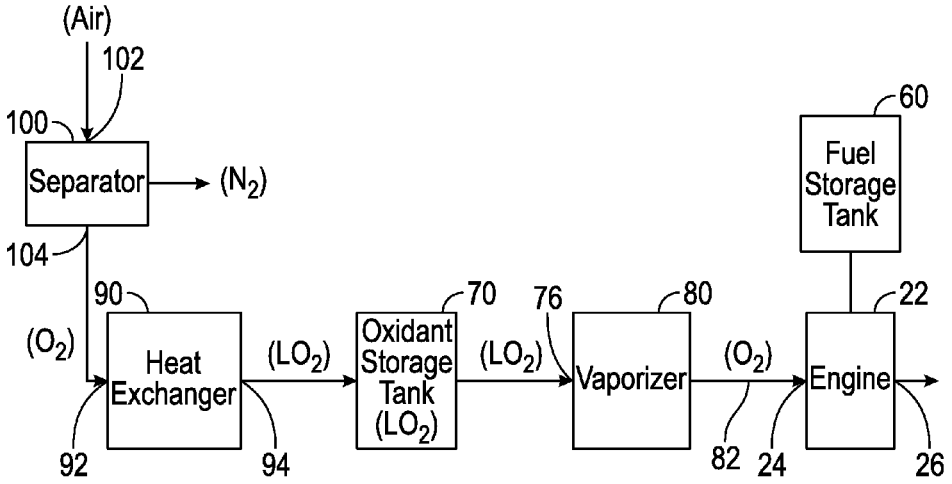
Figure 4D:
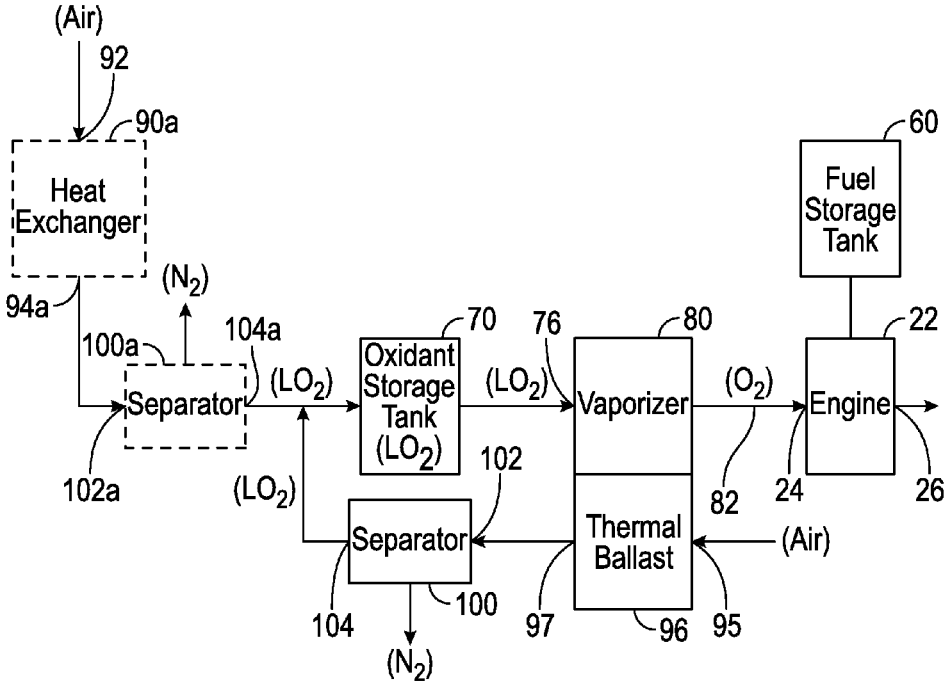
Figure 5:
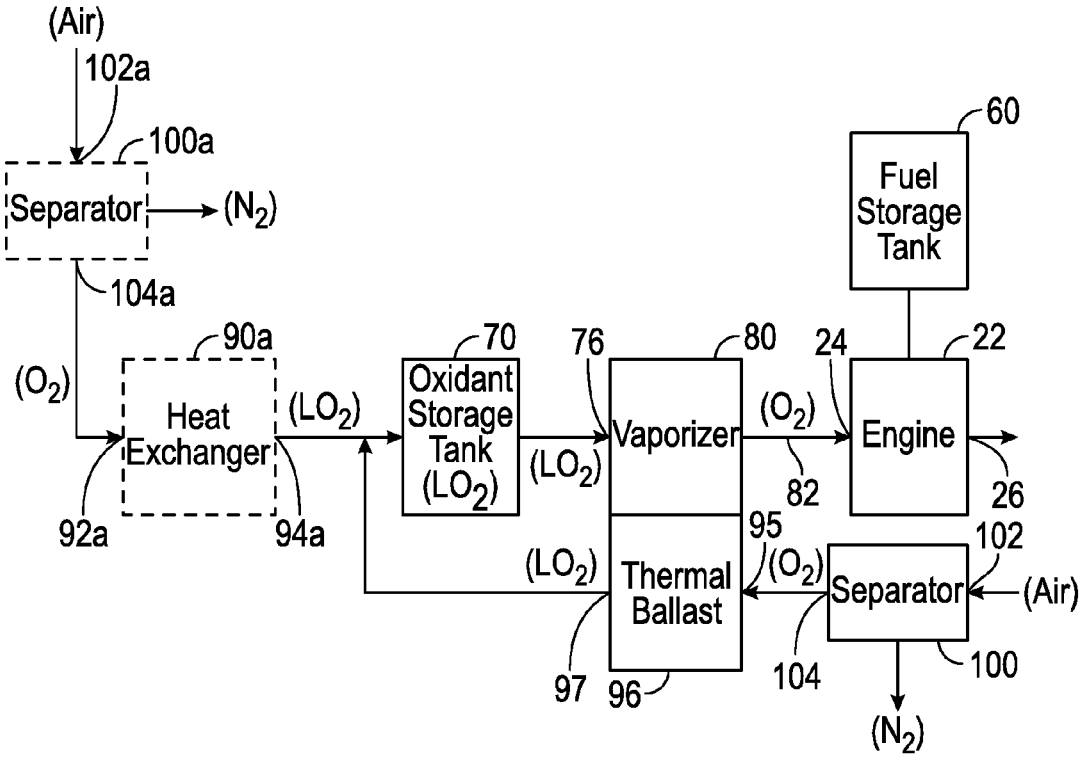

Referring now to FIGS. 4A-5, a power system of train 10 is shown to store liquid oxygen. As shown in FIGS. 4A-5, oxidant storage tank 70 is configured to store liquid oxygen. In other embodiments, oxidant storage tank 70 stores other liquid oxidants (e.g., liquid air, etc.). As shown in FIGS. 4A-5, oxidant storage tank 70 is in fluid communication with vaporizer 80 such that liquid oxygen is provided to vaporizer 80. Vaporizer 80 vaporizes the liquid oxygen into gaseous oxygen 82, which in turn flows to intake 24 of engine 22.

According to the embodiment shown in FIG. 4A, oxidant storage tank 70 is in fluid communication with vaporizer 80. In one embodiment, oxidant storage tank 70 receives liquid oxygen from an external source (e.g., at a fill station, etc.) when its liquid oxygen reserves have been depleted, for example. In other embodiments, the railway car (e.g., first railroad car 30, second railroad car 40, third railroad car 50, etc.) that oxidant storage tank 70 is coupled to is exchanged at a railway station for another railway car with a full oxidant storage tank 70.

As shown in FIG. 4B, the power system further includes heat exchanger 90 and separator 100. Separator 100 may be configured to increase an oxygen content of an oxidant fluid flow, and to output an oxygen enriched oxidant. In one embodiment, heat exchanger 90 and separator 100 are both part of (e.g., define portions of, etc.) a fractional condensation unit. The fractional condensation unit may be configured to selectively condense the constituents (e.g., oxygen, nitrogen, etc.) of an inlet oxidant fluid flow. By way of example, the fractional condensation unit may separate oxygen, having a boiling point of −183° C., from nitrogen, having a boiling point of −196° C. According to another embodiment, heat exchanger 90 and separator 100 are configured to otherwise separate constituents from the oxidant fluid flow.

As shown in FIG. 4B, heat exchanger 90 includes inlet 92 and outlet 94. Inlet 92 is in fluid communication with an air source. Heat exchanger 90 is configured to decrease the temperature of the gaseous air from the air source (e.g., the ambient environment, etc.) to facilitate production of liquid air or liquid oxygen and gaseous nitrogen. In one embodiment, heat exchanger 90 reduces the temperature of the gaseous air to produce liquid oxygen and gaseous nitrogen. Separator 100 and heat exchanger 90 may together schematically represent a fractional condensation unit. As shown in FIG. 4B, outlet 94 is coupled to inlet 102 of separator 100 such that oxygen and nitrogen from heat exchanger 90 are transferred to separator 100. Separator 100 is configured to separate the oxygen and the nitrogen. As shown in FIG. 4B, separator 100 exhausts (e.g., releases, etc.) the nitrogen. Outlet 104 of separator 100 is fluidly coupled to an inlet of oxidant storage tank 70 such that the separated oxygen may be stored for later use.

According to the embodiment shown in FIG. 4C, separator 100 is configured to increase the oxygen content of a gaseous oxidant (e.g., ambient air, etc.). By way of example, separator 100 may be configured to supply oxidant including gaseous oxygen to inlet 92 of heat exchanger 90. In one embodiment, separator 100 includes a pressure swing adsorption unit. The pressure swing absorption unit may be configured to pressurize the oxidant flow and expose the pressurized fluid to an adsorbent material (e.g., a zeolite sponge, etc.), which acts as a molecular sieve. One or more constituents (e.g., nitrogen) may be adsorbed based on their differential attraction to the adsorbent material relative to oxygen. Separator 100 may thereafter depressurize the oxidant flow to release the adsorbed gas molecules and regenerate the adsorbent material. In other embodiments, separator 100 includes a double-stage pressure swing adsorption unit, a rapid pressure swing adsorption unit, a vacuum pressure swing adsorption unit, a membrane separation unit, or still another system configured to increase the ratio of oxygen to other gases within the oxidant flow.

As shown in FIG. 4C, separator 100 is disposed along the flow path upstream of heat exchanger 90. Separator 100 is configured to increase the oxygen content of air from the ambient environment, according to one embodiment. As shown in FIG. 4C, gaseous air from the ambient environment enters inlet 102 of separator 100 as an oxidant fluid flow. Separator 100 may remove one or more constituents (e.g., nitrogen, etc.) of the gaseous air via an outlet (e.g., a nitrogen outlet configured to discharge nitrogen to the surrounding atmosphere, etc.) such that the oxidant fluid flow has an enhanced level of oxygen. The outlet may be coupled to a thermal ballast storage tank and may be configured to transfer nitrogen to the thermal ballast storage tank. In one embodiment, the oxygen-enhanced oxidant fluid flow thereafter exits separator 100 through outlet 104 and flows into heat exchanger 90.

According to the embodiment shown in FIG. 4C, inlet 92 of heat exchanger 90 is in fluid communication with outlet 104 of separator 100. Heat exchanger 90 is configured to decrease the temperature of gaseous oxygen received from separator 100 to facilitate production of liquid oxygen. In other embodiments, heat exchanger 90 liquefies a supply of gaseous oxygen to produce liquid oxygen. In another embodiment, heat exchanger 90 reduces the temperature of the gaseous oxygen and includes another device (e.g., a compressor, another thermal regulation unit, etc.) that facilitates producing liquefied oxygen. In one embodiment, heat exchanger 90 is coupled to oxidant storage tank 70. As shown in FIG. 4C, outlet 94 of heat exchanger 90 is coupled to an inlet of oxidant storage tank 70 such that liquid oxygen from heat exchanger 90 may be stored for later use.

According to the embodiment shown in FIG. 4D, thermal ballast system 96 and separator 100 schematically represent a fractional condensation unit. The fractional condensation unit may be configured to selectively condense the constituents (e.g., oxygen, nitrogen, etc.) of an inlet oxidant fluid flow. As shown in FIG. 4D, vaporizer 80 is driven by thermal ballast system 96.

As shown in FIG. 4D, inlet 95 of thermal ballast system 96 is in fluid communication with the air source (e.g., ambient air, etc.). By way of example, through the vaporization of liquid oxygen within vaporizer 80, the gaseous air flowing through thermal ballast system 96 is substantially cooled. The decrease in the temperature of the gaseous air facilitates the production of liquid oxygen. In one embodiment, thermal ballast system 96 reduces the temperature of the gaseous air to produce liquid oxygen and gaseous nitrogen. In another embodiment, thermal ballast system 96 reduces the temperature of the gaseous air and includes another device (e.g., a compressor, another thermal regulation unit, etc.) that facilitates producing liquefied oxygen. As shown in FIG. 4D, outlet 97 of thermal ballast system 96 is coupled to inlet 102 of separator 100 such that liquid oxygen from thermal ballast system 96 is transferred to separator 100. Separator 100 may be configured to separate the liquid oxygen from remaining liquid nitrogen or from gaseous nitrogen. As shown in FIG. 4D, separator 100 exhausts (e.g., releases, etc.) the nitrogen such that liquid oxygen is provided at outlet 104. Thermal ballast system 96 and separator 100 may thereby schematically represent a fractional condensation unit. The fractional condensation unit may be configured to separate oxygen, having a boiling point of −183° C., from nitrogen, having a boiling point of −196° C. By way of example, thermal ballast system 96 may reduce the temperature of the gaseous air flow therethrough until the oxygen therein liquefies, which is provided at outlet 104. The gaseous nitrogen may be exhausted. Outlet 104 of separator 100 is fluidly coupled to an inlet of oxidant storage tank 70 such that the separated liquid oxygen may be stored for later use. In other embodiments, outlet 104 of separator 100 is coupled directly to oxidant storage tank.

The power system of FIG. 4D further includes an optional auxiliary heat exchanger 90*a* and auxiliary separator 100*a*. As shown in FIG. 4D, auxiliary heat exchanger 90*a* is configured to receive gaseous air (e.g., ambient air, etc.) through inlet 92*a*, and auxiliary separator 100*a* provides liquid oxygen at outlet 104*a*. As shown in FIG. 4D, auxiliary separator 100*a* exhausts (e.g., releases, etc.) the nitrogen. Outlet 104*a* of auxiliary separator 100*a* is fluidly coupled to in inlet of oxidant storage tank 70 such that the separated liquid oxygen may be stored for later use. By way of example, auxiliary heat exchanger 90*a* and auxiliary separator 100*a* may be used where the process performed by vaporizer 80, thermal ballast system 96, and separator 100 does not produce enough liquid oxygen for the power demands of engine 22. In other embodiments, auxiliary separator 100*a* performs gas phase separation similar to separator 100 in FIG. 4C and is located upstream of auxiliary heat exchanger 90*a*, supplying it with gaseous oxygen as separator 100 did for heat exchanger 90 in FIG. 4C.

According to the embodiment shown in FIG. 5, separator 100 is configured to increase the oxygen content of a gaseous oxidant (e.g., ambient air, etc.). In one embodiment, separator 100 includes a pressure swing adsorption unit. As shown in FIG. 5, gaseous air from the ambient environment enters inlet 102 of separator 100 as an oxidant fluid flow. Separator 100 may remove one or more constituents (e.g., nitrogen, etc.) of the gaseous air such that the oxidant fluid flow has an enhanced level of oxygen. In one embodiment, the oxygen-enhanced oxidant fluid flow thereafter exits separator 100 through outlet 104 and into inlet 95 of thermal ballast system 96. As shown in FIG. 5, vaporizer 80 is driven by thermal ballast system 96 rather than an external source.

As shown in FIG. 5, inlet 95 of thermal ballast system 96 is in fluid communication with outlet 104 such that the oxygen-enriched gas enters thermal ballast system 96. By way of example, the vaporization of liquid oxygen within vaporizer 80 may be used to facilitate liquefying the gaseous oxygen flowing through thermal ballast system 96. In one embodiment, thermal ballast system 96 liquefies the gaseous oxygen to produce liquid oxygen. In another embodiment, thermal ballast system 96 reduces the temperature of the gaseous oxygen and includes another device (e.g., a compressor, another thermal regulation unit, etc.) that facilitates producing liquefied oxygen. As shown in FIG. 5, outlet 97 of thermal ballast system 96 is coupled to an inlet of oxidant storage tank 70 such that the liquid oxygen may be stored for later use. In other embodiments, outlet 97 is coupled directly to oxidant storage tank 70.

The power system of FIG. 5 further includes an optional auxiliary heat exchanger 90*a* and auxiliary separator 100*a*. Auxiliary separator 100*a* is configured to increase the oxygen content of air from the ambient environment, according to one embodiment. By way of example, auxiliary separator 100*a* may include a pressure swing adsorption unit. As shown in FIG. 5, gaseous air from the ambient environment enters inlet 102*a* of auxiliary separator 100*a* as an oxidant fluid flow. Auxiliary separator 100*a* may remove one or more constituents (e.g., nitrogen, etc.) of the gaseous air such that the oxidant fluid flow has an enhanced level of oxygen. In one embodiment, the oxygen-enhanced oxidant fluid flow thereafter exits auxiliary separator 100*a* through outlet 104*a* and flows into auxiliary heat exchanger 90*a*.

According to the embodiment shown in FIG. 5, inlet 92*a* of auxiliary heat exchanger 90*a* is in fluid communication with outlet 104*a* of auxiliary separator 100*a*. Auxiliary heat exchanger 90*a* is configured to decrease the temperature of gaseous oxygen from auxiliary separator 100*a* to facilitate production of liquid oxygen. In one embodiment, auxiliary heat exchanger 90*a* liquefies the gaseous oxygen to produce liquid oxygen. In another embodiment, auxiliary heat exchanger 90*a* reduces the temperature of the gaseous oxygen and includes another device (e.g., a compressor, another thermal regulation unit, etc.) that facilitates producing liquefied oxygen. In one embodiment, auxiliary heat exchanger 90*a* is coupled to oxidant storage tank 70. As shown in FIG. 5, outlet 94*a* is coupled to an inlet of oxidant storage tank 70 such that liquid oxygen from auxiliary heat exchanger 90*a* may be stored for later use. By way of example, auxiliary heat exchanger 90*a* and auxiliary separator 100*a* may be used where the process performed by vaporizer 80, thermal ballast system 96, and separator 100 does not produce enough liquid oxygen to satisfy the demands of engine 22. In other embodiments, auxiliary separator 100*a* and auxiliary heat exchanger 90*a* are configured to operate as did separator 100 and heat exchanger 90 as discussed for FIG. 4B. By way of example, auxiliary separator 100*a* and auxiliary heat exchanger 90*a* may together schematically represent a fractional condensation unit.

In one embodiment, at least one of heat exchanger 90 and auxiliary heat exchanger 90*a* are thermally coupled to a cryogenic thermal ballast such that a thermal exchange facilitates producing the liquid oxygen or liquid air. By way of example, the thermal ballast system may include a liquid fluid disposed within a storage tank. In one embodiment, the thermal exchange includes a transfer of energy from gaseous oxygen or air to the cryogenic thermal ballast. By way of example, the cryogenic thermal ballast may include liquid nitrogen (e.g., a liquid nitrogen supply, etc.) or another constituent having a temperature that is less than that of the oxidant (e.g., air, oxygen, etc.) at inlet 92 of heat exchanger 90 or inlet 92*a* of auxiliary heat exchanger 90*a*. By way of example, thermal ballast system 96 may also include liquid nitrogen or another constituent having a temperature that is less than that of the oxidant (e.g., air, gaseous nitrogen, oxygen, etc.) at inlet 95 of thermal ballast system 96 to further facilitate the production of liquid air or oxygen.

According to another embodiment, the cryogenic thermal ballast includes the liquid fuel stored within fuel storage tank 60. Liquid fuel stored within fuel storage tank 60 is vaporized before flowing into engine 22 as a gas. This vaporization of the fuel is endothermic, and the fuel absorbs energy equal to its latent heat of vaporization (e.g., 510 kJ/kg for pure methane at a pressure of 1.013 bar, etc.). In one embodiment, the vaporizing fuel absorbs energy as part of a thermal transfer used to liquefy air, pure gaseous oxygen, or a combination of oxygen and another gas. Even after vaporization, the fuel may be at a temperature equal to its boiling point (e.g., −161° C. for pure methane at a pressure of 1.013 bar, etc.). In one embodiment, the vaporized fuel absorbs energy as part of a thermal transfer used to facilitate liquefying air, pure gaseous oxygen, or a combination of oxygen and another gas. The thermal transfer may occur within heat exchanger 90, auxiliary heat exchanger 90*a*, or a thermal ballast system. By way of example, heat exchanger 90, auxiliary heat exchanger 90*a*, or the thermal ballast system may be coupled to a vaporizer for the fuel, such that a thermal exchange between the fuel (e.g., the liquid fuel, the vaporized fuel, etc.) and the gaseous oxygen or air facilitates producing the liquid oxygen or air. Accordingly, the liquid fuel used to fuel the train may also be used to facilitate producing liquid oxygen or air that is stored for later use.

In one embodiment, thermal ballast system 96 and oxidant storage tank 70 are both supported by a common railroad car (e.g., second railroad car 40). According to another embodiment, the thermal ballast system 96 is supported by a separate railroad car (e.g., third railroad car 50, etc.). A train having thermal ballast system 96 supported by a separate railroad car facilitates replacing the liquid nitrogen or other constituent of the cryogenic thermal ballast. By way of example, a train may deplete the cryogenic thermal ballast during a first portion of a trip, and the railroad car may be replaced at a depot, thereby replenishing the cryogenic thermal ballast without spending time refilling a tank.

According to one embodiment, heat exchanger 90 or auxiliary heat exchanger 90*a* are coupled to at least one of first railroad car 30, second railroad car 40, and third railroad car 50. By way of example, heat exchanger 90 may be coupled to a frame of one of the railroad cars. By way of another example, heat exchanger 90 or auxiliary heat exchanger 90*a* may be coupled to at least one of fuel storage tank 60 and oxidant storage tank 70. In one embodiment, heat exchanger 90 or auxiliary heat exchanger 90*a* and oxidant storage tank 70 are both supported by the frame of the same railroad car, thereby forming an oxidant liquefying and storage module that may be engaged, disengaged, and transported as a single railroad car. In another embodiment, vaporizer 80 and oxidant storage tank 70 are both supported by the frame of the same railroad car. Thermal ballast system 96 may be coupled to a second railroad car.

In one embodiment, at least one of separator 100, auxiliary separator 100*a*, and oxidant storage tank 70 is supported by a frame of a railroad car (e.g., second railroad car 40). Positioning at least one of separator 100, auxiliary separator 100*a*, and oxidant storage tank 70 on the same railroad car forms a module that may be engaged, disengaged, and transported as a unit. In another embodiment, at least one of separator 100 and auxiliary separator 100*a* is otherwise coupled to a train, thereby facilitating on-board enhancement of the oxidant fluid flow.

Figure 6:
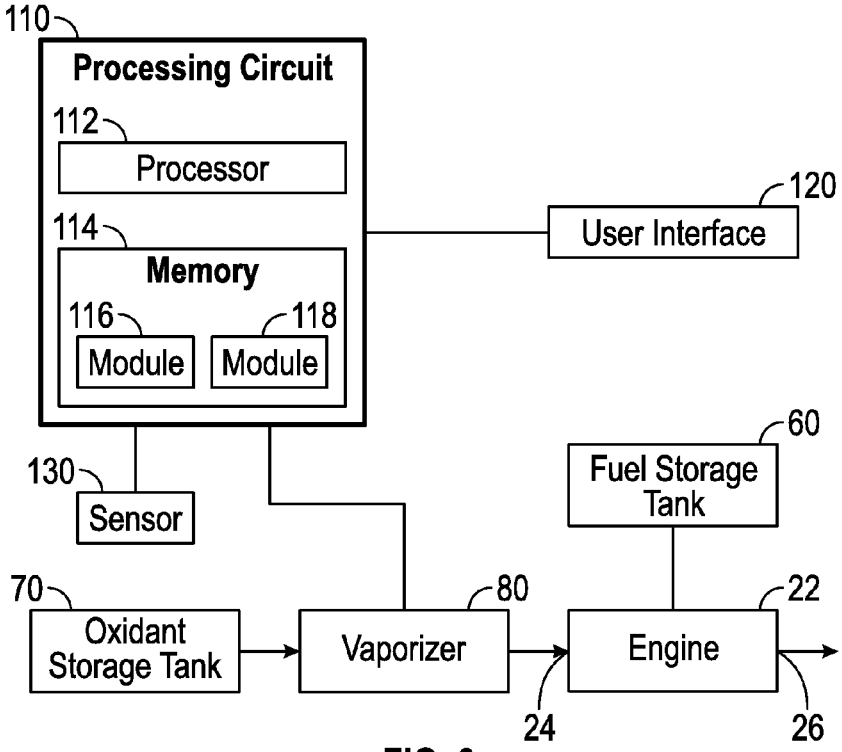
FIG. 6 is a schematic diagram of a power system for a locomotive that includes a processing circuit configured to engage a vaporizer, according to one embodiment.
Figure 7:
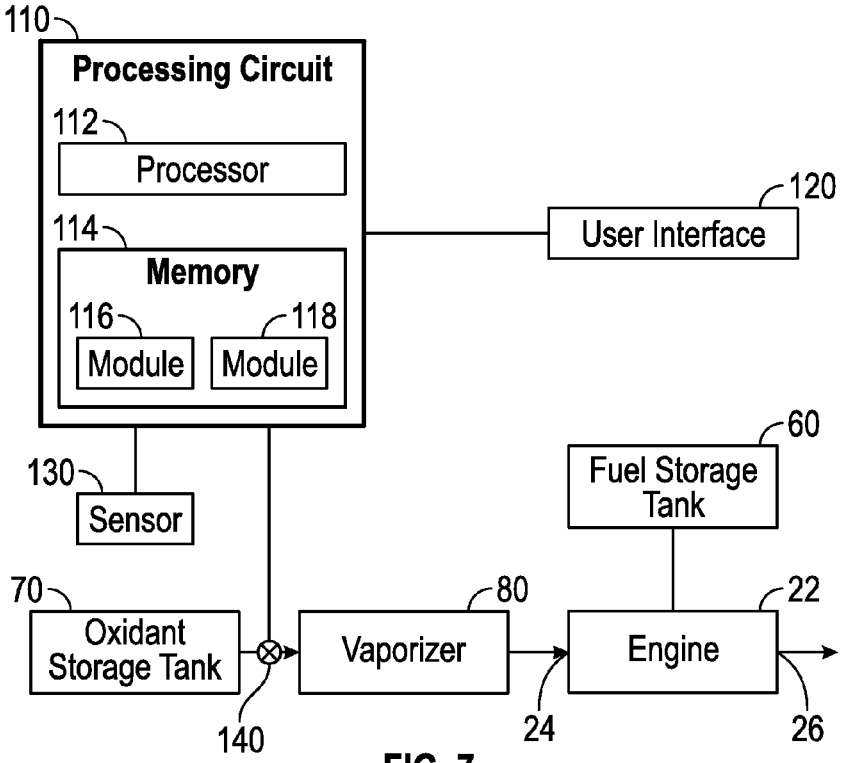
FIG. 7 is a schematic diagram of a power system for a locomotive that includes a processing circuit coupled to a flow control device, according to one embodiment.

Referring next to the embodiments shown in FIGS. 6-7, processing circuit 110 controls delivery of the oxygen-enhanced oxidant fluid flow to engine 22. Processing circuit 110 may be implemented as a general-purpose processor, an application specific integrated circuit (ASIC), one or more field programmable gate arrays (FPGAs), a digital-signal-processor (DSP), circuits containing one or more processing components, circuitry for supporting a microprocessor, a group of processing components, or other suitable electronic processing components. According to the embodiment shown in FIGS. 6-7, processing circuit 110 includes processor 112 and memory 114. Processor 112 may include an ASIC, one or more FPGAs, a DSP, circuits containing one or more processing components, circuitry for supporting a microprocessor, a group of processing components, or other suitable electronic processing components. In some embodiments, processor 112 is configured to execute computer code stored in memory 114 to facilitate the activities described herein. Memory 114 may be any volatile or non-volatile computer-readable storage medium capable of storing data or computer code relating to the activities described herein. According the embodiment shown in FIGS. 6-7, memory 114 includes module 116 and module 118 having computer code modules (e.g., executable code, object code, source code, script code, machine code, etc.) configured for execution by processor 112. In some embodiments, processing circuit 110 may represent a collection of processing devices (e.g., servers, data centers, etc.). In such cases, processor 112 represents the collective processors of the devices, and memory 114 represents the collective storage devices of the devices.

As shown in FIGS. 6-7, user interface 120 is coupled to processing circuit 110. User interface 120 is configured to at least one of send information to and receive information from processing circuit 110. By way of example, user interface may facilitate entry of information by a user. By way of another example, user interface 120 may include a display configured to illustrate one or more of the features discussed herein.

According to the embodiment shown in FIG. 6, processing circuit 110 is configured to selectively engage at least one of vaporizer 80 and an output valve from a post-vaporizer buffer tank. Vaporizer 80 may be configured to convert a portion of the liquid oxygen stored in oxidant storage tank 70 into a flow of gaseous oxygen when engaged. By way of example, vaporizer 80 may begin converting liquid oxygen into gaseous oxygen upon receiving a command signal generated by processing circuit 110. In one embodiment, gaseous oxygen flows to engine 22 when vaporizer 80 is engaged, thereby increasing the power output and responsiveness of engine 22 and reducing the emissions therefrom.

In one embodiment, processing circuit 110 generates the command signal upon receiving user input from user interface 120. According to another embodiment, processing circuit 110 evaluates an oxygen enrichment setting relating to the flow of oxygen to engine 22 (e.g., the flow of gaseous oxygen into intake 24 of engine 22). Processing circuit 110 may determine the oxygen enrichment setting based upon the user input. By way of example, the user input may relate to a requested power demand or an emissions reduction. An operator may provide the user input as the train begins to approach a grade, as the train begins to approach a city or other area sensitive to emissions, or during high air-pollution periods.

According to another embodiment, processing circuit 110 is configured to provide the command signal based on an oxidant control strategy. In one embodiment, processing circuit 110 is configured to selectively engage vaporizer 80 based on a speed of the train and/or locomotive. In another embodiment, processing circuit 110 is configured to selectively engage vaporizer 80 based on a slope of railway track upon which at least a portion of the train is located. In still other embodiments, processing circuit 110 is configured to selectively engage vaporizer 80 based on the power output of engine 22. In yet other embodiments, processing circuit 110 is configured to determine an oxygen enrichment setting relating to the flow of oxygen to engine 22. By way of example, the oxygen enrichment setting may include a ratio of oxygen to other gases within a combustion chamber of engine 22, a ratio of oxygen to fuel within the combustion chamber of engine 22, an amount of oxygen within the combustion chamber of engine 22 during a combustion stage of the combustion reaction, or still another relationship for the flow of oxygen to engine 22. In one embodiment, intake 24 of engine 22 includes a port open to a supply of ambient air. The port may allow engine 22 to selectively operate on ambient air, on oxidant from oxidant storage tank 70, or a mixture of the two. In one embodiment, the oxygen enrichment setting relates to a ratio of oxygen to ambient air. In another embodiment, the oxygen enrichment setting relates to a ratio of oxygen to ambient air and fuel.

As shown in FIG. 6, sensor 130 is coupled to processing circuit 110. In one embodiment, sensor 130 is configured to provide sensing signals relating to a power demand of engine 22. By way of example, the sensing signals may relate to a load on engine 22. A larger load may suggest that the train is traveling up a grade, and processing circuit 110 may engage vaporizer 80 to provide engine 22 with intake air having an enhanced level of oxygen, thereby increasing a power output and responsiveness of engine 22. Such an increase in power output and responsiveness may allow the train to travel up the grade more quickly and reduce the delays traditionally associated with elevation changes. According to another embodiment, sensor 130 is positioned in exhaust 26 of engine 22 and configured to provide sensing signals relating to an oxygen ratio in exhaust 26 (e.g., a ratio of oxygen to other gases in the exhaust gases from engine 22). Processing circuit 110 may determine the oxygen enrichment setting based on the sensing signals. By way of example, an oxygen ratio that is below a lower threshold level may indicate that engine 22 is running too lean whereas an oxygen ratio that is above an upper threshold level may indicate that engine 22 is running too oxygen-rich. In other embodiments, processing circuit 110 is configured to determine the oxygen enrichment setting based on a speed of the locomotive. In still other embodiment, processing circuit 110 is configured to determine the oxygen enrichment setting based on a slope of railway track upon which at least a portion of the train and/or locomotive is located.

In another embodiment, sensor 130 is configured to provide sensing signals relating to a location of the train. By way of example, sensor 130 may include a global positioning receiver configured to interface with a global positioning system to determine the position of the train. The oxidant control strategy may include generating the command signal to engage vaporizer 80 when the train is at high altitude (e.g., with a reduced density of ambient air), when the train enters a particular region (e.g., an area around a city or other emissions sensitive area), when the train travels over a particular length of track (e.g., a portion of track associated with a known grade), or during high air-pollution periods for a region. Such an oxidant control strategy may reduce emissions from engine 22 or increase the power of engine 22, respectively, based on the position of the train.

In still another embodiment, sensor 130 includes an altimeter configured to provide sensing signals relating to the altitude of the train, and processing circuit 110 is configured to evaluate sensing signals. The oxidant control strategy may include generating the command signal once processing circuit 110 determines that the train is traveling across a grade above a threshold level (e.g., a two percent grade). By way of example, processing circuit 110 may determine the grade based on the change in altitude and a distance traveled by the train.

According to the embodiment shown in FIG. 7, flow control device 140 is disposed along a flow path between oxidant storage tank 70 and intake 24 of engine 22. As shown in FIG. 7, flow control device 140 is disposed along the flow path between oxidant storage tank 70 and vaporizer 80. According to another embodiment, flow control device 140 is disposed along the flow path between vaporizer 80 and intake 24 of engine 22. As shown in FIG. 7, flow control device 140 is a valve that is movable between an open position and a closed position. In other embodiments, the flow control device includes a pump, nozzle, or still another device configured to regulate the oxidant flow to engine 22.

Referring still to the embodiment shown in FIG. 7, processing circuit 110 is coupled to flow control device 140. A command signal may be generated by processing circuit 110, and the valve may open and close in response to the command signal. In one embodiment, processing circuit 110 generates the command signal based on a user input. In another embodiment, processing circuit generates the command signal as part of an oxidant control strategy. The oxidant control strategy may include evaluating sensing signals generated by sensor 130 (e.g., relating to a load on engine 22, relating to an oxygen ratio in exhaust 26, relating to a location of the train, relating to an altitude of the train, etc.).

Figure 8:
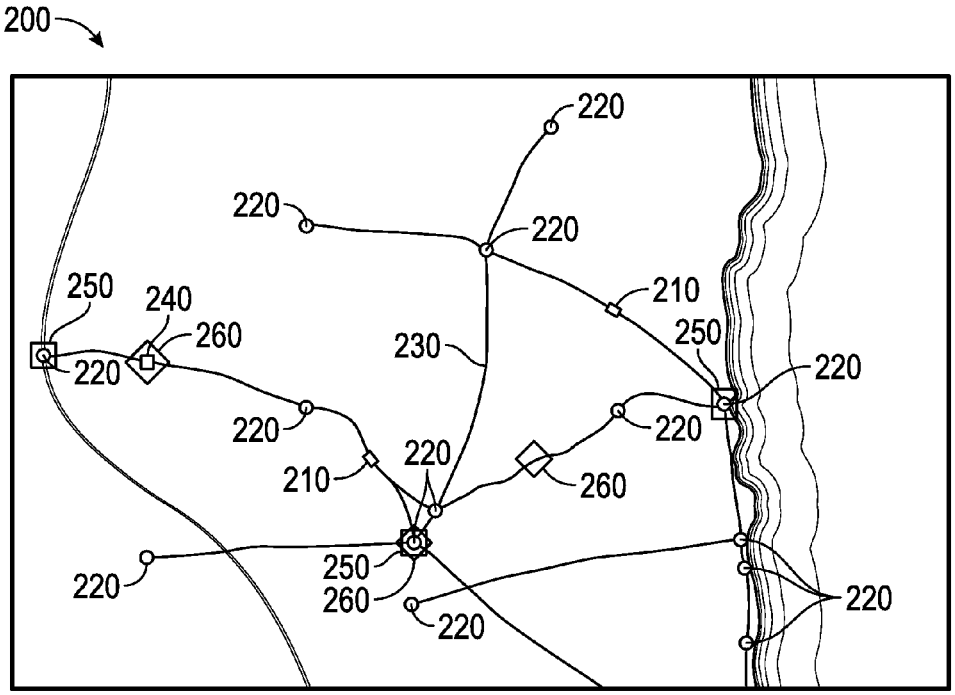
FIG. 8 is a map that shows an operational area for a train, according to one embodiment.

Referring next to the embodiment shown in FIG. 8, map 200 shows an overhead view of an operational area for train 210. As shown in FIG. 8, a plurality of train stations 220 are coupled by rail lines 230. In one embodiment, fuel is produced at fuel production site 240. By way of example, natural gas may be liquefied at fuel production site 240 from a natural gas source. Train propellant management systems and methods are discussed in U.S. application Ser. No. 14/069,095, titled "Train Propellant Management Systems and Methods," filed Oct. 31, 2013, which is incorporated herein by reference in its entirety. Fuel production site 240 may be disposed along rail lines 230 to facilitate the transport of liquefied natural gas to fuel storage sites 250. As shown in FIG. 8, fuel storage sites 250 are disposed in proximity to train stations 220. In other embodiments, fuel storage sites 250 are otherwise positioned along rail lines 230.

Referring still to FIG. 8, depot sites 260 are positioned along rail lines 230. In one embodiment depot sites 260 include a heat exchanger configured to facilitate liquefying gaseous oxygen. Depot sites 260 may also include a separator having an oxidant inlet. The separator may be configured to increase an oxygen content of an oxidant fluid flow and to output an oxygen enriched oxidant. An outlet of the separator may be coupled to an oxidant inlet of the heat exchanger (e.g., such that the separator is configured to supply oxidant including gaseous oxygen to the oxidant inlet of the heat exchanger, etc.). The heat exchanger and the separator may define portions of a fractional condensation unit. The oxidant inlet of the separator may be in fluid communication with a supply of ambient air. In some embodiments, the separator includes a nitrogen outlet configured to discharge nitrogen to the atmosphere.

The liquid oxygen may be transferred to train 210 and provided to an engine thereof to at least one of increase power output, increase responsiveness, and reduce emissions. In one embodiment, the liquid oxygen is pumped from depot site 260 to an oxidant storage tank of train 210. In another embodiment, the liquid oxygen is disposed within a storage tank that is positioned on a railroad car. The railroad car may be attached to train 210 as part of an oxidant replenishing processes, whereby a supply of an oxidant (e.g., liquefied air, liquefied pure oxygen, etc.) is provided to train 210. By way of example, a railroad car containing an empty (e.g., an entirely empty, a partially empty, etc.) oxidant storage tank may be replaced with a railroad car containing a full oxidant storage tank. In another embodiment, an empty oxidant storage tank is removed from a railroad car of train 210 (e.g., using a crane) and replaced with a full oxidant storage tank. Replacing railroad cars or oxidant storage tanks reduces the time required to replenish the oxidant supply aboard train 210, according to one embodiment.

As shown in FIG. 8, depot sites 260 are positioned along rail lines 230 proximate to fuel production site 240, train stations 220, and fuel storage sites 250. In other embodiments, depot sites are positioned only along rail lines 230 between train stations 220, only at train stations 220, only at fuel storage sites 250, only at fuel production site 240, or any combination thereof. Positioning depot sites 260 at fuel storage sites 250 may facilitate replenishment of the oxidant supply aboard train 210. In one embodiment, train 210 transports (i.e., carries) an amount of oxidant that corresponds to an amount of fuel aboard an onboard fuel storage tank. An operator of train 210 may refuel and replenish the oxidant supply at a single location without needing to make additional stops along rail lines 230. In one embodiment, the amount of oxidant and the amount of fuel aboard train 210 are equal (e.g., train 210 may use an amount of oxidant that is equal to the amount of fuel consumed). In other embodiments, train 210 carries an amount of oxidant that corresponds to a combustion ratio of fuel and the oxidant. In still another embodiment, train 210 carries an amount of oxidant that corresponds to an anticipated use along a projected path. By way of example, the anticipated use may be related to the terrain along the projected path (e.g., whether the terrain is flat or includes a number of grades, etc.), the environment along the projected path (e.g., whether the projected path passes a city or other emissions-sensitive area), a target completion time, whether the trip may occur during a period of high air-pollution, or a combination thereof.

In one embodiment, the heat exchanger at depot sites 260 is thermally coupled to a cryogenic thermal ballast such that a thermal exchange facilitates production of the liquid oxygen. In embodiments where depot site 260 is positioned at fuel production site 240, the same cryogenic thermal ballast may be used to facilitate production of liquid fuel and liquid oxidant. The cryogenic thermal ballast may include liquid nitrogen. A fuel storage tank may be used to store the liquid fuel for later use by train 210. An auxiliary oxidant storage tank may be positioned at depot site 260 and configured to store liquid oxygen for later use by train 210. The auxiliary oxidant storage tank may be configured to store liquid nitrogen and/or liquid air (e.g., where the oxidant includes nitrogen and/or air, respectively, etc.). Depot site 260 may include a second heat exchanger configured to facilitate liquefying a gaseous fuel into a liquid fuel. By way of example, the liquid fuel may include at least liquid methane, and the gaseous fuel may include at least gaseous methane. By way of another example, the liquid fuel may include at least liquid hydrogen, and the gaseous fuel may include at least gaseous hydrogen. The second heat exchanger may include an inlet that is in fluid communication with a source of the gaseous fuel and an outlet that is in fluid communication with an auxiliary fuel storage tank.

Figure 9:
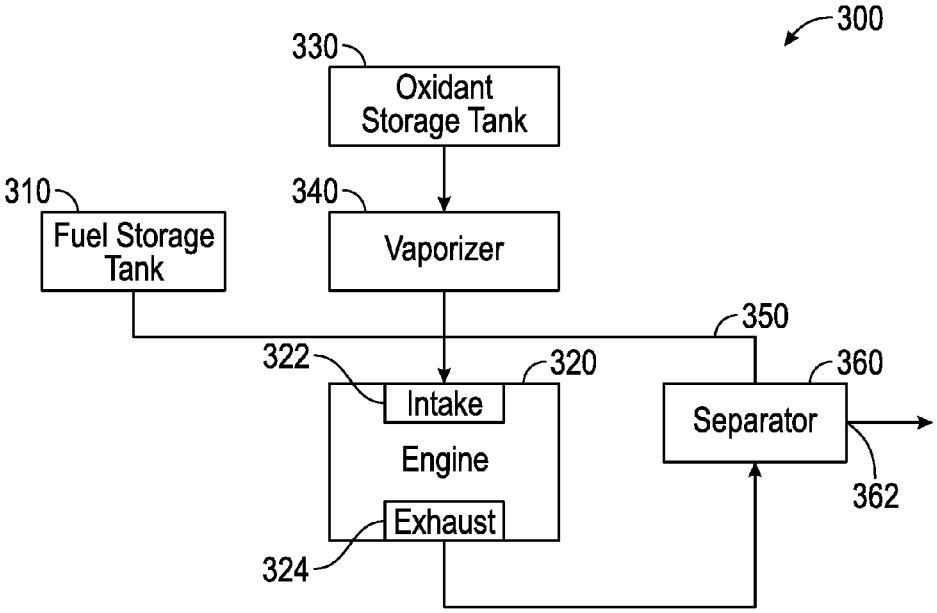
FIG. 9 is a schematic diagram of a power system for a locomotive having an intake of an engine coupled to an exhaust of the engine, according to one embodiment.

Referring next to the embodiment shown in FIG. 9, power system 300 for a locomotive is configured to utilize engine exhaust as a working fluid. The working fluid decreases the ratio of fuel and oxygen to other gases within the combustion chamber of engine 320, thereby decreasing the combustion temperature within the combustion chamber and increasing the efficiency of engine 320 relative to traditional power systems. As shown in FIG. 9, power system 300 includes fuel storage tank 310, engine 320, oxidant storage tank 330, vaporizer 340, and piping system 350. In one embodiment, fuel storage tank 310 is configured to contain liquid fuel, and oxidant storage tank 330 is configured to contain a liquid oxidant. Vaporizer 340 is coupled to oxidant storage tank and configured to provide a flow of gaseous oxygen, according to one embodiment.

Engine 320 is configured to combust fuel in a combustion reaction, according to one embodiment. It should be understood that the combustion reaction produces a plurality of exhaust constituents (e.g., carbon dioxide, $NO_x$, carbonaceous particulates, water, etc.). According to the embodiment shown in FIG. 9, engine 320 includes intake 322 and exhaust 324. Intake 322 and exhaust 324 are coupled such that at least a portion of the exhaust constituents form a working fluid that flows along a recirculating flow path (i.e., the flow path from exhaust 324 to intake 322). As shown in FIG. 9, fuel from fuel storage tank 310 is combined with the working fluid along the recirculating flow path. In one embodiment, a vaporizer converts liquid within fuel storage tank 310 into a gas. Vaporizer 340 is configured to provide a flow of gaseous oxygen to the working fluid along the recirculating flow path, and the combination of fuel, the working fluid, and oxygen flows into intake 322. As shown in FIG. 9, fuel, oxygen, and the working fluid are combined upstream of intake 322. In other embodiments, one or more of fuel, oxygen, and the working fluid are separately provided to intake 322. In still other embodiments, one or more of fuel, oxygen, and the working fluid are separately provided to a combustion chamber of engine 320.

Referring still to FIG. 9, separator 360 is disposed along the recirculating flow path. In one embodiment, separator 360 is configured to remove a second portion of the plurality of exhaust constituents. In another embodiment, separator 360 is configured to remove at least a portion of one of the plurality of exhaust constituents (e.g., water, a contaminant, etc.). Separator 360 may dispense the removed constituents to the ambient environment or a storage tank via outlet 362.

In one embodiment, power system 300 operates engine 320 fuel-rich (i.e., power system 300 provides excess fuel to engine 320), and the plurality of exhaust constituents include fuel. A processing circuit may vary the amount of fuel and oxygen that is provided to engine 320. In one embodiment, the processing circuit sends a command signal to at least one of vaporizer 340 and a flow control device. The command signal may vary the amount of oxygen provided to intake 322 of engine 320, thereby controlling the combustion reaction.

Figure 10:
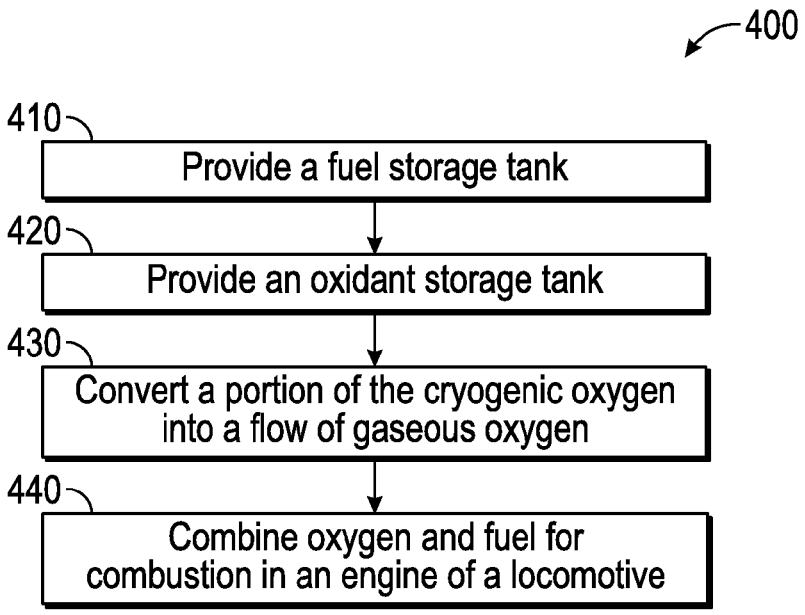
FIGS. 10-11 are schematic views of methods for powering a train, according to various embodiments.

Referring next to FIG. 10, method 400 for powering a train is used to increase the power output and responsiveness of a locomotive. In another embodiment, method 400 is used to decrease the emissions generated by a locomotive. As shown in FIG. 10, method 400 includes providing a fuel storage tank (410) configured to contain liquid fuel, providing an oxidant storage tank (420) configured to contain liquid oxygen, converting a portion of the liquid oxygen (430) into a flow of gaseous oxygen, and combining the flow of gaseous oxygen and the fuel for combustion in an engine of a locomotive (440).

Figure 11:
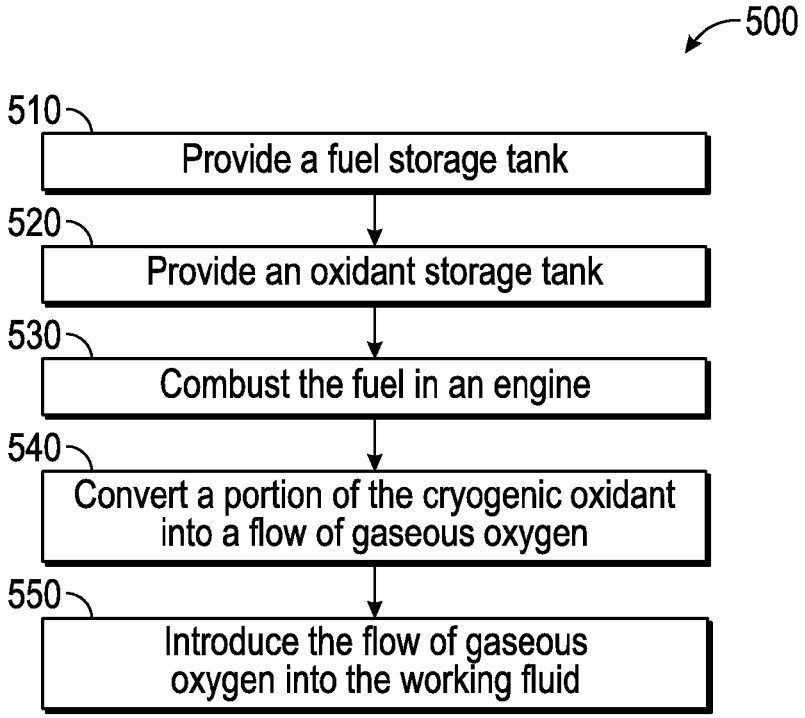

According to the embodiment shown in FIG. 11, method 500 for powering a train includes providing a fuel storage tank (510) configured to contain liquid fuel, providing an oxidant storage tank (520) configured to contain liquid oxygen, and combusting the fuel in an engine (530). The engine includes an intake and an exhaust that are coupled by a recirculating flow path, and a plurality of exhaust constituents form a working fluid that flows along the recirculating flow path. Method 500 also includes converting a portion of the liquid oxygen (540) into a flow of gaseous oxygen and introducing the flow of gaseous oxygen into the working fluid (550) to perpetuate the combustion reaction.

It is important to note that the construction and arrangement of the elements of the systems and methods as shown in the embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements. It should be noted that the elements and/or assemblies of the enclosure may be constructed from any of a wide variety of materials that provide sufficient strength or durability, in any of a wide variety of colors, textures, and combinations. The order or sequence of any process or method steps may be varied or re-sequenced, according to other embodiments. Other substitutions, modifications, changes, and omissions may be made in the design, operating conditions, and arrangement of the preferred and other embodiments without departing from scope of the present disclosure or from the spirit of the appended claims.

The present disclosure contemplates methods, systems, and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data, which cause a general-purpose computer, special purpose computer, or special purpose processing machines to perform a certain function or group of functions.

Although the figures may show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule-based logic and other logic to accomplish the various connection steps, processing steps, comparison steps, and decision steps.

What is claimed is:

1. A train, comprising:

a fuel storage tank configured to contain liquid fuel;

a locomotive including an engine having an intake and configured to combust the fuel in a combustion reaction to provide a power output;

an oxidant storage tank configured to contain at least liquid oxygen; and a vaporizer disposed along a flow path between the oxidant storage tank and the intake, wherein the vaporizer is configured to convert a portion of the liquid oxygen into a flow of gaseous oxygen and provide the flow of gaseous oxygen to the intake thereby increasing the power output of the engine; and a heat exchanger having an oxidant inlet and an oxidant outlet, wherein the heat exchanger is configured to facilitate liquefying gaseous oxygen into liquid oxygen.

2. The train of claim 1, wherein the heat exchanger is coupled to the oxidant storage tank.

3. The train of claim 2, wherein the oxidant outlet of the heat exchanger is coupled to an inlet of the oxidant storage tank.

4. The train of claim 1, further comprising a separator having an oxidant inlet, wherein the separator is configured to increase an oxygen content of an oxidant fluid flow, and to output an oxygen enriched oxidant.

5. The train of claim 4, wherein the separator and the heat exchanger define portions of a fractional condensation unit.

6. The train of claim 5, wherein the heat exchanger is thermally coupled to the vaporizer, facilitating a transfer of energy from the heat exchanger to the vaporizer.

7. The train of claim 4, wherein the separator comprises a nitrogen outlet.

8. The train of claim 1, wherein the heat exchanger is thermally coupled to a cryogenic thermal ballast such that a thermal exchange facilitates production of the liquid oxygen.

9. The train of claim 8, further comprising a first railroad car and a second railroad car, wherein the oxidant storage tank and the heat exchanger are both coupled to the first railroad car and the cryogenic thermal ballast is disposed within a tank coupled to the second railroad car.

10. The train of claim 1, wherein the vaporizer is thermally coupled to a thermal ballast such that a thermal exchange facilitates production of the gaseous oxygen.

11. The train of claim 1, further comprising a processing circuit configured to selectively engage the vaporizer to convert the portion of the liquid oxygen into the flow of gaseous oxygen.

12. The train of claim 1, further comprising a flow control device disposed along a flow path between the vaporizer and the intake.

13. The train of claim 12, further comprising a processing circuit coupled to the flow control device and configured to provide a command signal, wherein the flow control device is configured to selectively open and close in response to the command signal.

14. The train of claim 1, further comprising a processing circuit configured to determine an oxygen enrichment setting relating to the flow of gaseous oxygen into the intake.

15. The train of claim 1, wherein the heat exchanger at least one of (a) liquefies gaseous oxygen into liquid oxygen, (b) cooperates with a compressor to liquefy gaseous oxygen into liquid oxygen, and (c) cooperates with a thermal regulation unit to liquefy gaseous oxygen into liquid oxygen.

16. A power system for a locomotive, comprising:

a fuel storage tank configured to contain liquid fuel;

an engine having an intake and configured to combust the fuel in a combustion reaction to provide a power output;

an oxidant storage tank configured to contain at least liquid oxygen; and a vaporizer coupled to the oxidant storage tank and configured to convert a portion of the liquid oxygen into a flow of gaseous oxygen, wherein the vaporizer is coupled to the intake such that the flow of gaseous oxygen to the intake increases the power output of the engine; and a heat exchanger having an oxidant inlet and an oxidant outlet, wherein the heat exchanger is configured to facilitate liquefying gaseous oxygen into liquid oxygen.

17. The system of claim 16, further comprising a separator having an oxidant inlet, wherein the separator is configured to increase an oxygen content of an oxidant fluid flow, and to output an oxygen enriched oxidant.

18. The system of claim 17, wherein the separator and the heat exchanger define portions of a fractional condensation unit.

19. The system of claim 18, wherein the heat exchanger is thermally coupled to the vaporizer, facilitating a transfer of energy from the heat exchanger to the vaporizer.

20. The system of claim 16, wherein the heat exchanger is thermally coupled to a cryogenic thermal ballast such that a thermal exchange facilitates production of the liquid oxygen.

21. The system of claim 16, wherein the oxidant outlet is in fluid communication with an oxidant inlet of the oxidant storage tank.

22. The system of claim 21, wherein the oxidant is air, and wherein the oxidant inlet of the heat exchanger is in fluid communication with a supply of ambient air.

23. The system of claim 21, wherein the heat exchanger is thermally coupled to the vaporizer, facilitating a transfer of energy from the heat exchanger to the vaporizer.

24. The system of claim 21, wherein the heat exchanger is thermally coupled to a cryogenic thermal ballast such that a thermal exchange facilitates production of the liquid oxidant.

25. The system of claim 16, wherein the vaporizer is thermally coupled to a thermal ballast such that a thermal exchange facilitates production of the gaseous oxygen.

26. The system of claim 16, further comprising a processing circuit configured to selectively engage the vaporizer to convert the portion of the liquid oxygen into the flow of gaseous oxygen.

27. The system of claim 16, further comprising a flow control device disposed along a flow path between the vaporizer and the intake.

28. The system of claim 27, further comprising a processing circuit coupled to the flow control device and configured to provide a command signal, wherein the flow control device is configured to selectively open and close in response to the command signal.

29. The system of claim 16, further comprising a processing circuit configured to determine an oxygen enrichment setting relating to the flow of gaseous oxygen into the intake.

30. The system of claim 16, wherein the heat exchanger at least one of (a) liquefies gaseous oxygen into liquid oxygen, (b) cooperates with a compressor to liquefy gaseous oxygen into liquid oxygen, and (c) cooperates with a thermal regulation unit to liquefy gaseous oxygen into liquid oxygen.

31. A fuel management system, comprising:

a train including:

a fuel storage tank configured to contain liquid fuel;

an oxidant storage tank configured to contain at least liquid oxygen;

a vaporizer coupled to the oxidant storage tank and configured to convert a portion of the liquid oxygen into a flow of gaseous oxygen; and a locomotive including an engine having an intake and configured to combust the fuel in a combustion reaction to provide a power output, wherein the vaporizer is coupled to the intake such that the flow of gaseous oxygen to the intake increases the power output of the engine; and a depot site including a heat exchanger configured to facilitate liquefying at least gaseous oxygen into at least liquid oxygen.

32. The system of claim 31, wherein the heat exchanger is thermally coupled to a cryogenic thermal ballast such that a thermal exchange facilitates production of the liquid oxygen.

33. The system of claim 31, wherein the depot site further comprises a separator having an oxidant inlet, wherein the separator is configured to increase an oxygen content of an oxidant fluid flow, and to output an oxygen enriched oxidant.

34. The system of claim 31, further comprising an auxiliary oxidant storage tank configured to contain at least liquid oxygen.

35. The system of claim 34, wherein the auxiliary oxidant storage tank is positioned at the depot site.

36. The system of claim 31, wherein the heat exchanger at least one of (a) liquefies gaseous oxygen into liquid oxygen, (b) cooperates with a compressor to liquefy gaseous oxygen into liquid oxygen, and (c) cooperates with a thermal regulation unit to liquefy gaseous oxygen into liquid oxygen.

* * * * *